US006840869B2

(12) United States Patent
Chen

(10) Patent No.: US 6,840,869 B2
(45) Date of Patent: Jan. 11, 2005

(54) AIMING DEVICE FOR GOLF PUTTER

(76) Inventor: David Chen, No. 1598, Jungshan Rd., Shengang Shiang, Taichung (TW), 429

( * ) Notice: Subject to any disclaimer, the term of this patent is extended or adjusted under 35 U.S.C. 154(b) by 0 days.

(21) Appl. No.: 10/424,710

(22) Filed: Apr. 29, 2003

(65) Prior Publication Data

US 2004/0152531 A1 Aug. 5, 2004

(51) Int. Cl.[7] ..... A63B 57/00
(52) U.S. Cl. ..... 473/220
(58) Field of Search ..... 473/220–270; 362/102, 234, 250, 259

(56) References Cited

U.S. PATENT DOCUMENTS 5,569,098 A * 10/1996 Klein ..... 473/300
5,788,588 A * 8/1998 Hooker ..... 473/409
5,964,668 A * 10/1999 Tai et al. ..... 473/220
6,238,298 B1 5/2001 Chen ..... 473/220
6,435,974 B1 8/2002 Chen ..... 473/220
6,450,893 B1 * 9/2002 Primiano et al. ..... 473/220
6,605,005 B1 * 8/2003 Lin ..... 473/220

* cited by examiner

*Primary Examiner*—Gregory Vidovich
*Assistant Examiner*—Nini F. Legesse
(74) *Attorney, Agent, or Firm*—Bacon & Thomas PLLC

(57) ABSTRACT

An aiming device for a golf club. The device includes a fixing seat with a long body, and one side of the body is thicker than the other side and the fixing seat has a wedgy shape. A clamping portion with a C-shape in cross view sets beside the long body thereof for clamping on a club or a grip of the golf. There is a connect portion on the other side of the long body. A main body in a long shape has a connect portion at one side thereof and connects with the connect portion of the fixing seat. A laser member pivots on the main body and towards the head. A switch sets on the main body for controlling on and off of the laser member.

6 Claims, 4 Drawing Sheets

AIMING DEVICE FOR GOLF PUTTER

BACKGROUND OF THE INVENTION

1. Field of the Invention

The present invention relates to an exerciser, and more particularly to an aiming device for the golf putter.

2. Description of the Related Art

There were two early inventions invented by the same inventor similar to the present invention. One of these early inventions is disclosed in U.S. Pat. No. 6,238,298. This patent discloses an aiming device that can clamp on the club or grip and move away easily. The aiming device has a laser member thereon that can be rotated and adjusted, which can project a mark line to assist the user to aim the club. The club and the head has an included angle θ as shows in FIG. 4 so that the device has to adjust towards the club after being mounted so that the mark line shows on the center of the head. However the laser member becomes an obstruction to the user's sight.

Another of these early inventions is U.S. Pat. No. 6,435,974. The height of the aiming device is pressed as close to the club as possible in this invention to prevent it from becoming an obstruction to the user's sight. This device changes the available adjust angle of the laser member and creates some problems since the club becomes larger and has an included angle θ.

SUMMARY OF THE INVENTION

The primary objective of the present invention is to provide an aiming device for golf putter which can clamp on the club or grip and move easily and avoid the problem in using with the club that has larger include angle.

To achieve aforesaid objective, an aiming device for golf putter provided by the present invention comprises a fixing seat with a long body, one side of the body is thicker than the other side and makes the fixing seat becoming wedgy shape. A clamping portion with a C-shape in cross view sets beside the long body thereof for clamping on a club or a grip of the golf and makes the thicker side of the long body on the top. There is a connect portion on the other side of the long body. A main body in long shape has a connect portion at one side thereof and connect with said connect portion of the fixing seat. A laser member pivots on the main body and toward the head. A switch sets on the main body also for controlling on and off of the laser member.

DETAILED DESCRIPTION OF THE INVENTION

Figure 1:
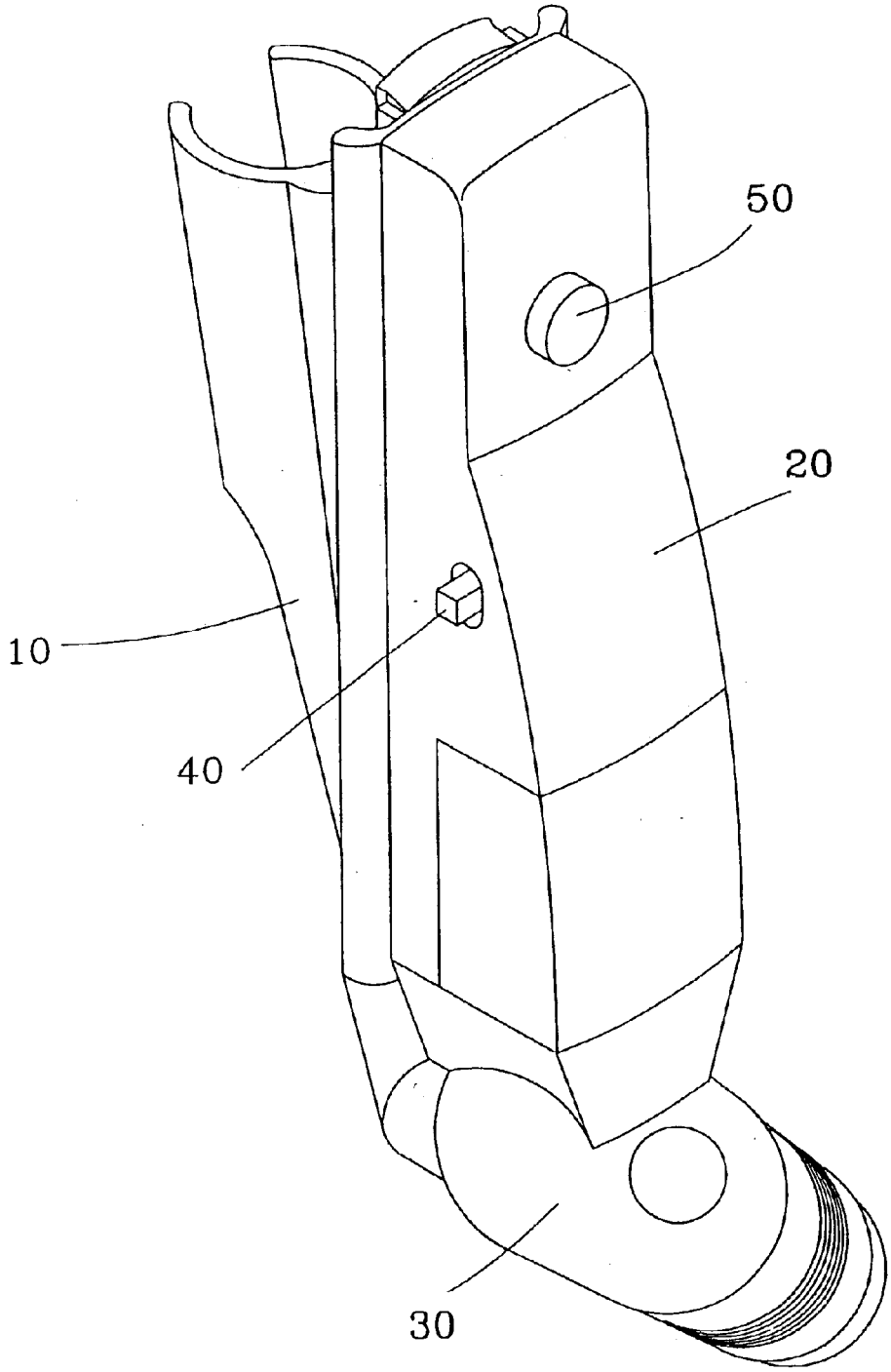
FIG. 1 is an outside view of the present invention.
Figure 2:
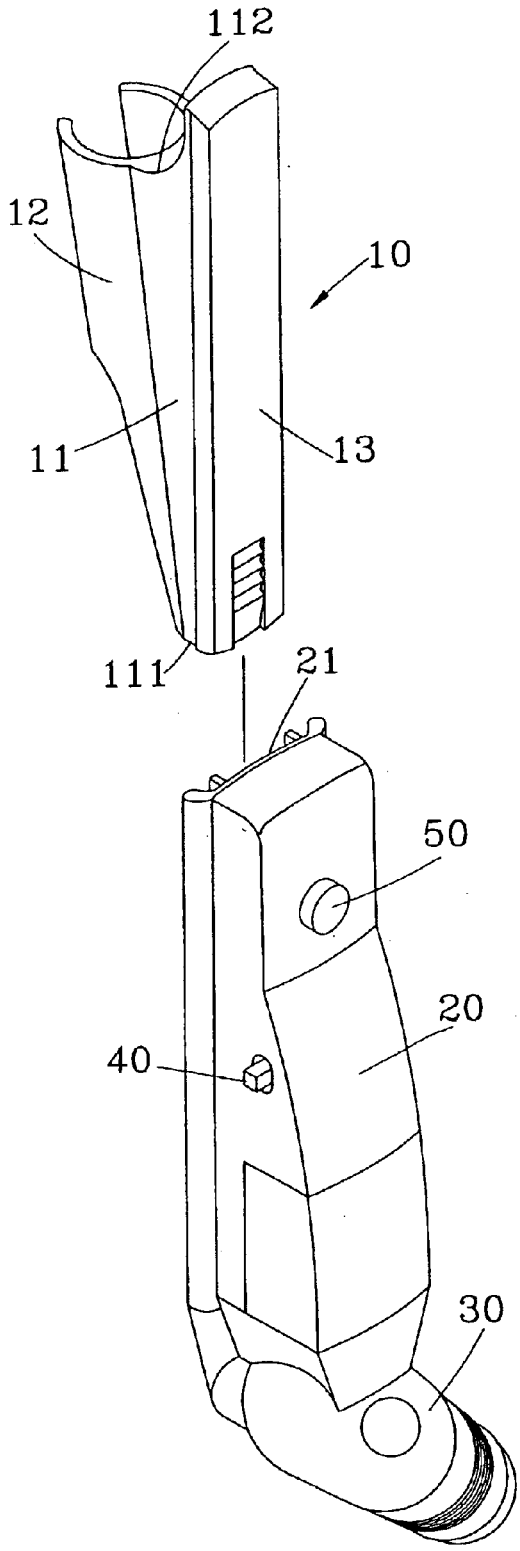
FIG. 2 is an explode view of some parts of the present invention.

As show in these FIGS., the aiming device for the golf putter of present invention comprising:

A fixing seat 10 with a long body 11. One side 112 of the body is thicker than the other side 111 and makes the fixing seat becoming wedgy shape. A clamping portion 12 with a C-shape in cross view sits beside the long body thereof for clamping on a club 70 or a grip 80 of the golf. In this embodiment of present invention, the clamping portion clamps on the club 70 and makes the thicker side 112 of the long body on the top. There is a connect portion 13 on the other side of the long body.

A main body 20 in long shape has a connect portion 21 at one side thereof. The connect portion 21 can connect with the connect portion 13 of the fixing seat. In this embodiment of present invention, the connect portion 21 of the main body is a dove tailed chase and the connect portion 13 of the fixing seat is a tenon for the dove tailed chase.

Figure 3:
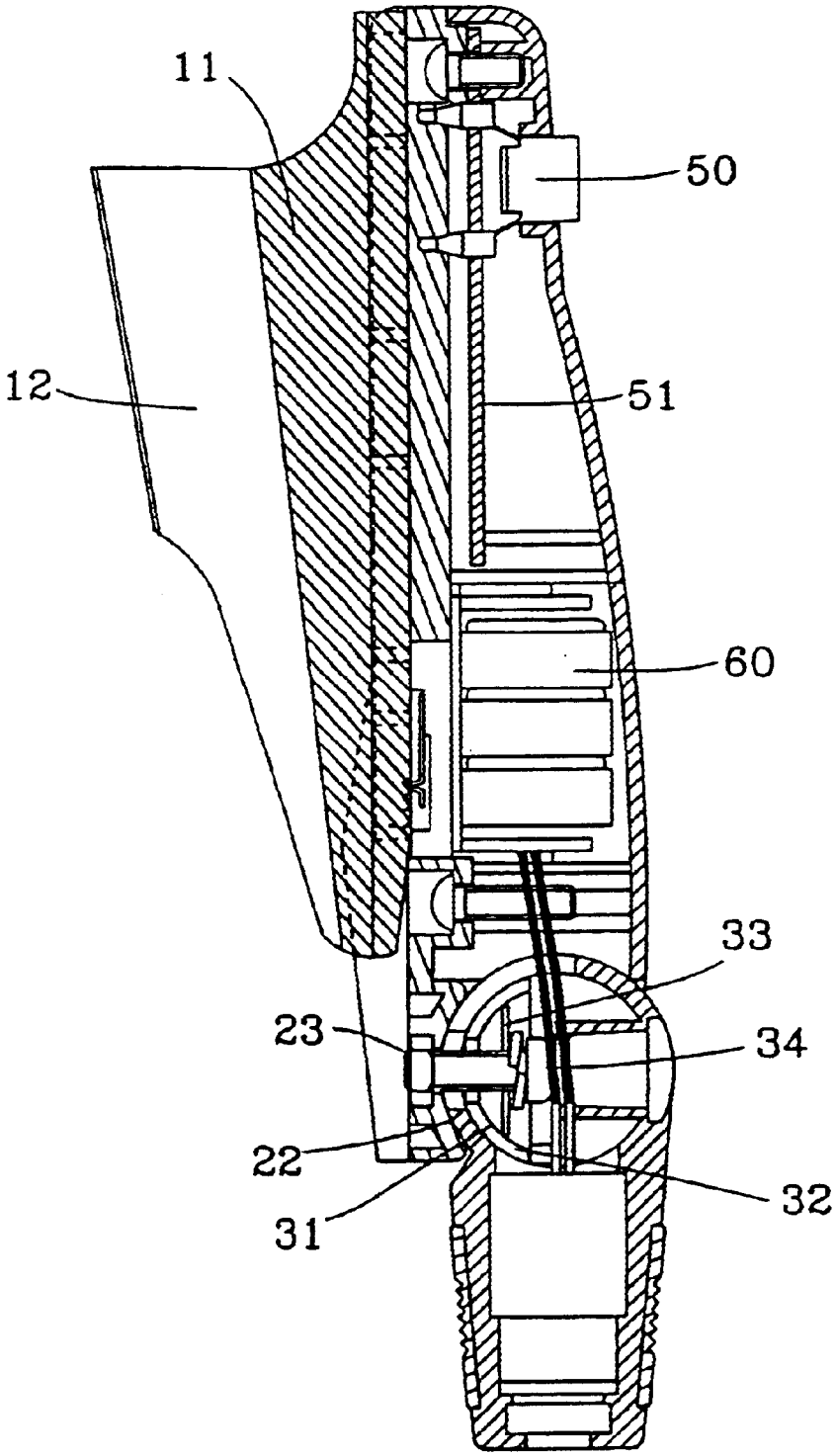
FIG. 3 is a section view along the 3—3 section line in FIG. 1 of the present invention.
Figure 4:
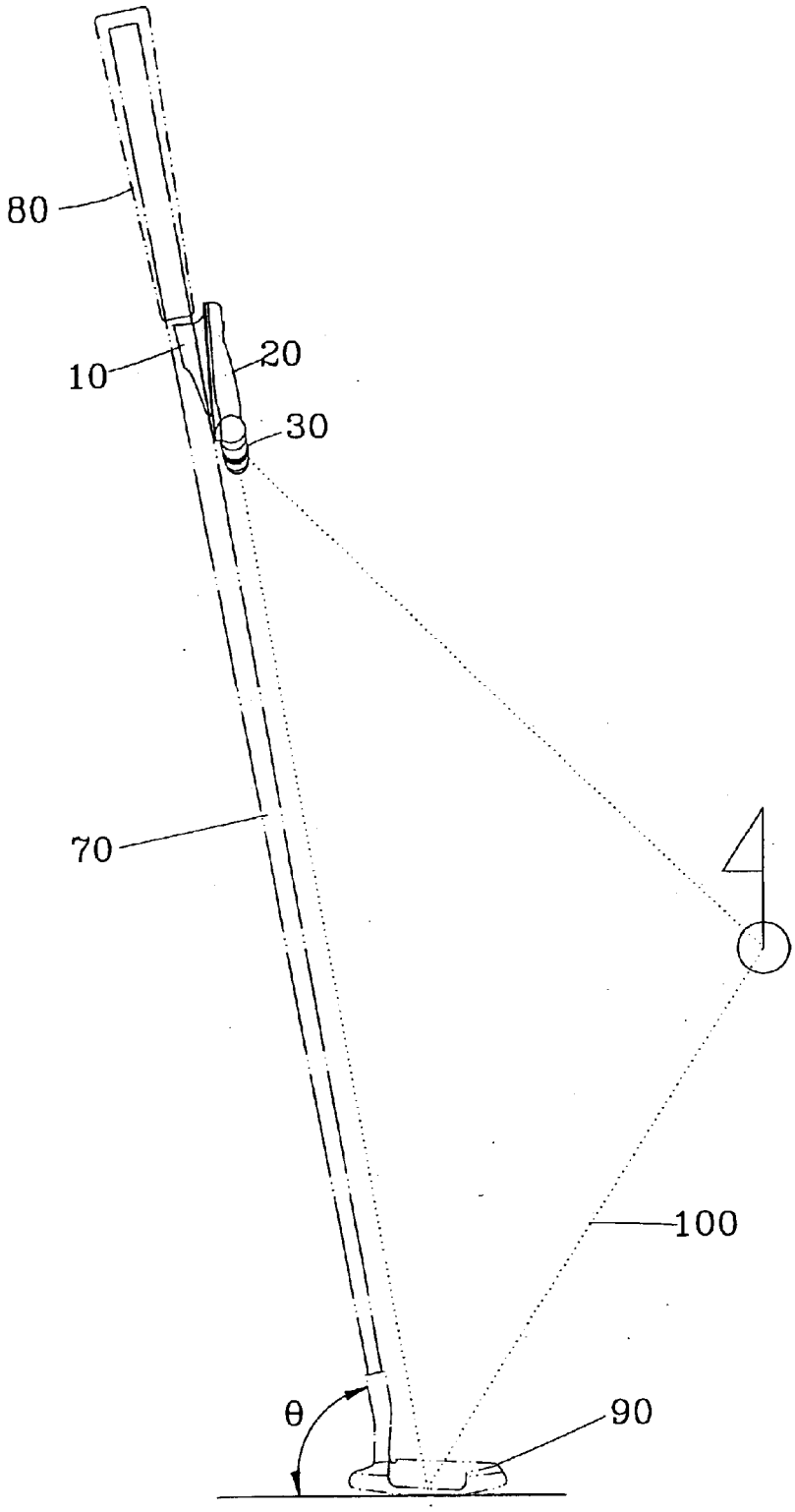
FIG. 4 is a outside view of the present invention, showing the operation situation of present invention.

A laser member 30 pivots on said main body 20 and toward the head 90 as shows in FIG. 3. In this embodiment of present invention, there is an embowed recession 22 at one side of the main body. The laser member has an embowed connecter 31 with an embowed shore 32 pivots at the inside wall of the embowed connecter 31. A press board 33 sets on the inside wall of the embowed shore 32. A locking member 34(stud) that is through the holes of the press board 33 and the embowed shore 32 and the embowed connecter 31 fix on the nut 23 in the embowed recession 22 of the main body. By adjusting the locking member 34, the laser member 30 can adjust the angle and fix. A bore at the corresponding position of the locking member thereof for user to adjust the locking member. The laser member has a laser producer inside and a polarizer at the front end for refracting the laser to inject a narrow mark line 100.

There is a switch 40 on the main body 20 also for controlling on and off of the laser member 30.

There is a microswitch 50 at the other end of the main body 20 and connect with a delay circuit 51. The laser member can inject a mark line and shut down after a predestinate period when the microswitch had been press.

A power pack sets in the main body for supply the electric power. In this embodiment of present invention, the power pack is a mercury battery.

Because of the fixing seat of present invention is designed in the wedgy shape, the injection angle of the laser member can toward to the club naturally and the problem of the insufficient adjusting angle of the laser member will be solved.

What is claimed is:

1. An aiming device for a golf putter comprising:

a fixing seat with a long body, a first side of the body is thicker than a second side thereof, the fixing seat comprises a wedgy shape, a clamping portion with a C-shape in cross-view sits besides said long body thereof for clamping on a club or a grip of a golf club, the first side of the long body is positioned higher than the second side of said long body, a first connect portion positioned on the second side of said long body;

a main body comprising a long shape and having a second connect portion at one side thereof and connects with said first connect portion of the fixing seat;

a laser member pivots on said main body towards a head of a golf club;

a switch sits on the main body for controlling the on and off of the laser member; and said fixing seat is attachable to a shaft of a golf club, between a grip of a golf club and a head of a golf club.

2. The aiming device for a golf putter as claimed in claim 1, wherein said connect portion of the main body is a dove tailed chase and the connect portion of the fixing seat is a tenon for the dove tailed chase.

3. The aiming device for a golf putter as claimed in claim 1, wherein said switch on the main body is a microswitch.

4. The aiming device for a golf putter as claimed in claim 3, wherein said main body has a delay circuit and the laser member emits a laser beam as a mark line and shuts down after a predetermined period when the microswitch had been press.

5. The device for a golf putter as claimed in claim 1, wherein said main body has a microswitch and a delay circuit and the laser member emits a laser beam as a mark line and shuts down after a predetermined period after the microswitch is actuated.

6. The aiming device for a golf putter as claimed in claim 1, wherein said laser member emits a laser beam as a narrow mark line.

* * * * *